US006836256B2

(12) United States Patent
Hung

(10) Patent No.: US 6,836,256 B2
(45) Date of Patent: Dec. 28, 2004

(54) DUAL-BAND VHF-UHF ANTENNA SYSTEM

(75) Inventor: Frédéric Ngo Bui Hung, Franconville (FR)

(73) Assignee: Thales, Paris (FR)

( * ) Notice: Subject to any disclaimer, the term of this patent is extended or adjusted under 35 U.S.C. 154(b) by 0 days.

(21) Appl. No.: 10/396,712

(22) Filed: Mar. 26, 2003

(65) Prior Publication Data

US 2003/0227419 A1 Dec. 11, 2003

(30) Foreign Application Priority Data

Mar. 26, 2002 (FR) ..... 02 03765

(51) Int. Cl.[7] ..... H01Q 9/04; H01Q 1/32
(52) U.S. Cl. ..... 343/790; 343/715
(58) Field of Search ..... 343/711, 715, 343/749, 790, 791, 876; 455/118, 121, 127.1, 129

(56) References Cited

U.S. PATENT DOCUMENTS 5,969,690 A * 10/1999 Yamabayashi et al. ..... 343/792
5,977,920 A 11/1999 Hung ..... 343/715
6,195,065 B1 2/2001 Hung et al. ..... 343/876
6,229,495 B1 * 5/2001 Lopez et al. ..... 343/791
6,404,396 B1 6/2002 Hung et al. ..... 343/749
6,429,821 B1 * 8/2002 Lewis, Jr. ..... 343/749
6,664,934 B2 * 12/2003 Barna ..... 343/860

* cited by examiner

*Primary Examiner*—Don Wong
*Assistant Examiner*—Minh Dieu A
(74) *Attorney, Agent, or Firm*—Lowe Hauptman Gilman & Berner LLP.

(57) ABSTRACT

A wideband antenna system is capable of radiating or receiving signals in a low-frequency band [Fbb, Fbh] covering more than one octave and a high-frequency band [Fhb, Fhh] with Fhb>=2Fbh comprising at least one power supply device (4) powering at least one upper radiating element (1) and at least one lower radiating element (2). The lower radiating element (2) is provided with at least one antenna assembly (10) adapted to radiating in the high-frequency band [Fhb, Fhh]. Application to RF signals. FIG. 3 to be published.

30 Claims, 6 Drawing Sheets

DUAL-BAND VHF-UHF ANTENNA SYSTEM

BACKGROUND OF THE INVENTION

1. Field of the Invention

The present invention relates especially to an antenna system capable of working in several distinct frequency ranges, for example a first frequency band which is a low-frequency band [Fbb, Fbh] covering at least one octave and a second frequency band, which is a high frequency band [Fhb, Fhh], the two bands being separated by a difference such that Fhb>=2Fbh.

2. Description of the Prior Art

Broadband antennas capable of working with radio equipment in the VHF (Very High Frequency) band, covering frequencies of 30 to 88 MHz, are known in the prior art.

For example, the U.S. Pat. Nos. 4,496,953 and 4,302,760 describe antennas of this kind. FIG. 1 is an exemplary antenna A installed on a land vehicle V. The antenna is formed essentially by an upper radiating element 1 and a lower radiating element 2, both powered by means of a power supply device 4. A mounting base 5, usually provided with a spring 6 to protect the antenna from accidental impact against obstacles, is used to install this antenna on the vehicle. To provide the vehicle with radioelectrical insulation against the ground of the vehicle, the lower radiating element 2 is normally equipped at its lower end with an RF cable choke 3.

Modern transmitter-receiver (or transceiver) stations, working for example in the 30–88 MHz band, presently have a service channel that implements other frequency bands, especially the UHF (ultra-high frequency) bands in the 2.4–2.5 GHz frequency range. The radiating elements 1 and 2 of the above-mentioned wideband antenna, which have a length sized for the 30–88 MHz VHF band, typically a length of about 1.6 meters, are not appropriate for efficient operation at the 2.4–2.5 GHz UHF frequencies. These frequencies indeed necessitate radiating elements whose size is about thirty times smaller.

For these VHF transmitter-receiver stations having a UHF service channel, the commonly adopted solution lies in providing for an additional antenna A' dedicated to this UHF channel as shown in FIG. 2*a*. An exemplary schematic installation diagram of this solution is shown in FIG. 2*b* which gives a diagrammatic view of a transmitter-receiver station 7 powering a VHF antenna A and a UHF antenna A' through a duplexer 8 whose role is to separate the VHF frequencies and the UHF frequencies and route them towards their respective antennas.

However, this solution gives rise to requirements of installation that entail very heavy constraints. These are:

- the need to have a free location on the vehicle to mount the additional UHF antenna,
- the need to obtain heightwise clearance for this additional UHF antenna, which is small-sized, so that it is not masked by other devices of the same vehicle,
- the need to have an external duplexer to separate the VHF main channel from the UHF service channel if the transmitter-receiver station has only one output connector for both channels.

SUMMARY OF THE INVENTION

The object of the present invention relates to an antenna system making it possible to have a single wideband antenna, simultaneously covering at least two distinct frequency bands, a low-frequency band [Fbb, Fbh] covering at least one octave and a high frequency band [Fhb, Fhh], the two bands being separated by a difference such that Fhb>=2Fbh. For example, it is possible to work in the 30–88 MHz VHF band and the 2.4–2.5 GHz UHF band.

The invention relates to a wideband antenna system, capable of radiating or receiving signals in a low-frequency band [Fbb, Fbh] covering more than one octave and a high-frequency band [Fhb, Fhh] with Fhb>=2Fbh comprising at least one power supply device powering at least one upper radiating element and at least one lower radiating element, wherein the lower radiating element is provided with at least one antenna assembly adapted to radiating in the high-frequency band [Fhb, Fhh].

The power supply device is connected, for example, to a transmitter-receiver station by means of a transmission line and the lower radiating element is constituted, for example, by a section of the transmission line and the antenna assembly comprises at least one hollow radiating element positioned around the section.

The system may comprises several elements connected to one another and serially by means of line portions, the core of one portion connecting the upper end of the hollow element indexed i to the lower end of the element indexed i+1 and the shielding of the line portion indexed i is connected to the coaxial line, for example to the shielding of the line.

A duplexer is placed, for example, at the lower part of the antenna assembly and is connected to at least one hollow element and to the line section.

The system is used, for example, for RF signals.

The object of the invention has the following advantages in particular:

- it removes the need for installing a second antenna for the UHF channel and prevents all the drawbacks that flow from such an antenna, for example bulkiness,
- by following certain types of layout, the antenna assembly which contributes to the radiation of the UHF band can be shifted heightwise, thus optimizing the quality of the radio link in this band, which is not the case for the usual installations with a second antenna mounted directly on the roof of the carrier vehicle,
- it provides the possibility of making the UHF band with directivity greater than that of a half-wave dipole antenna, making it possible to increase the range of the radio link in this band.

BRIEF DESCRIPTION OF THE DRAWINGS

Other characteristics and advantages of the invention shall appear more clearly from the following description, given by way of an example, and from the appended figures, of which.

MORE DETAILED DESCRIPTION

In the different figures, the corresponding elements are designated by the same references.

Figure 1:
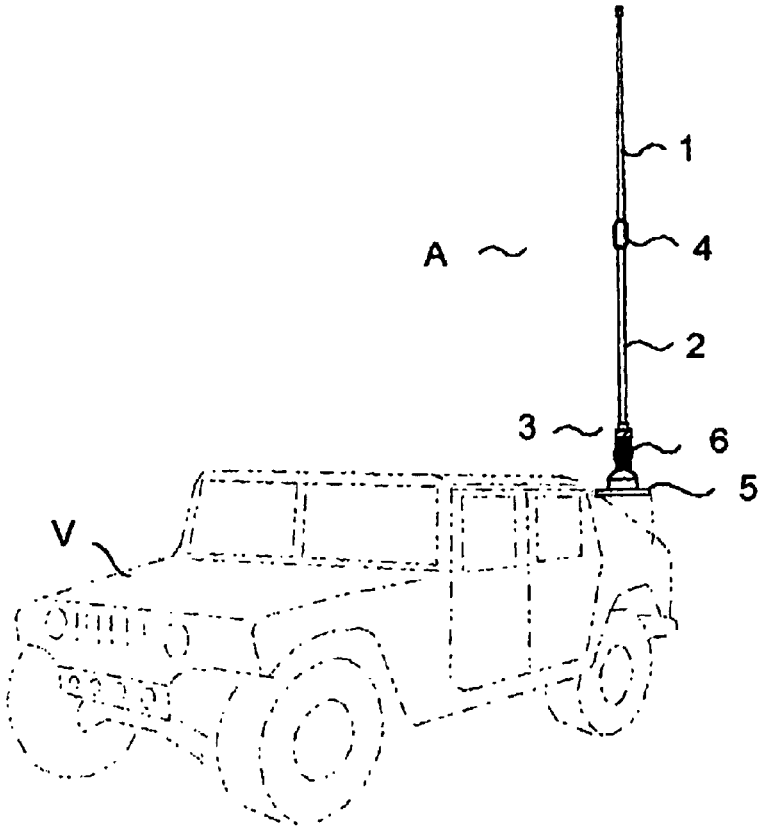
FIG. 1 shows an exemplary antenna according to the prior art.
Figure 2A:
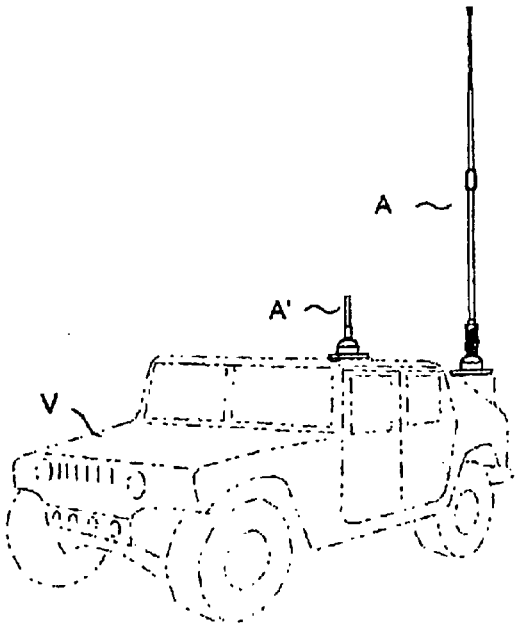
FIGS. 2*a* and 2*b* show, firstly, a transmitter-receiver station comprising an antenna for the VHF channel and an antenna for the UHF channel and, secondly, the schematic diagram of this station.
Figure 2B:
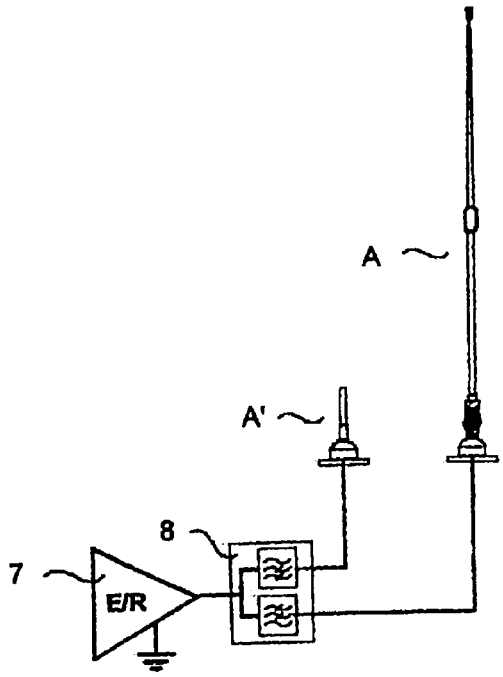
Figure 3:
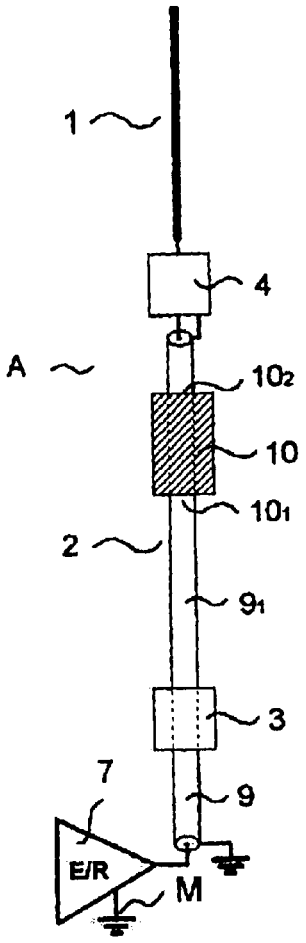
FIG. 3 is a block diagram of the antenna according to the invention.

FIG. 3 shows a block diagram of an antenna according to the invention. This antenna is designed to work especially in the two frequency bands, namely the 30–88 MHz VHF band and the 2.4–2.5 GHz UHF band. In this example, the antenna is installed on a vehicle.

The antenna A is formed, for example, by a power supply device 4 connected to a transmitter-receiver station 7 through a transmission line 9 that is coaxial or substantially coaxial. The characteristic impedance value of this line is equal to the value usually adopted for radiocommunications systems, namely 50 ohms. The antenna comprises, for example:

an upper radiating element 1 made, for example, according to principles known to those skilled in the art, for example a conductive strand with a length of about 1.6 meters, a lower radiating element 2 formed by a section $\mathbf{9}_1$ of the coaxial transmission line 9 and comprising, for example, an RF cable choke 3 and an antenna assembly 10 designed for the UHF band positioned at the level of the section. The section $\mathbf{9}_1$ is delimited, for example, by the power supply device 4 and the RF cable choke 3. The antenna assembly 10 is positioned between a lower reference mark $\mathbf{10}_1$ and an upper reference mark $\mathbf{10}_2$. This antenna assembly provides especially for efficient radiation in the 2.4–2.5 GHz UHF band. The reference marks $\mathbf{10}_1$,$\mathbf{10}_2$ are chosen, for example, to be as close as possible to the power supply device 4 so that the antenna assembly can be shifted heightwise. This provides for improved transmission and reception.

The distance between the power supply device 4 and the RF cable choke 3 is in the range of 1.6 meters. In this exemplary embodiment, the ground M of the vehicle is taken as being the common ground of the entire system.

In order to enable the making of an antenna that can be dismantled into several short-length pieces for transportation, the coaxial transmission line 9 is constituted, for example, by several sections. These sections are connected together by using, for example, known devices that are not shown, such as male and female coaxial connectors, etc. The mounting base 5 and its spring 6, the mechanical means that fixedly join the antenna to these elements 5 and 6, and the ancillary elements (such as the radome, connectors etc.) that provide for the rigidity and the assembling of the constituent elements shall not be described in detail because they are not essential to an understanding of the invention.

The RF cable choke 3 (adapted to VHF), whose role is to radioelectrical demarcate the section $\mathbf{9}_1$ from the transmission line 9, is made for example according to techniques known to those skilled in the art. For example, the implementation of a skirt about the coaxial transmission line or the winding of this line around a ferrite ring etc. shall not be described in detail for the sake of clarity.

The upper radiating element 1 and the lower radiating element 2 constitute, for example, the two strands of a dipole sized to radiate in the VHF frequency band, for example throughout the 30 to 88 MHz band. They are powered through the power supply device 4 which carries out impedance matching to enable the maximum transfer of RF power conveyed by the coaxial transmission line 9. This is true throughout the 30–88 MHz frequency band. An exemplary embodiment of the power supply device 4 is shown diagrammatically in FIG. 5.

Figure 4:
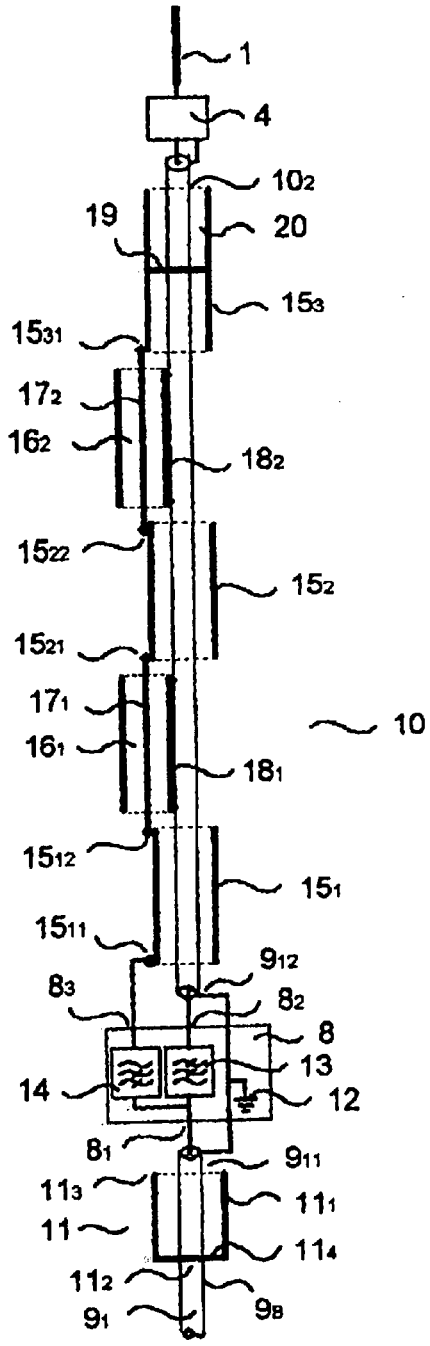
FIG. 4 is a sectional view of an embodiment of the antenna assembly according to the invention.

FIG. 4 is a sectional view of an exemplary embodiment of the antenna assembly 10. In this antenna assembly 10, the line section $\mathbf{9}_1$ is interrupted in order to position, for example, a duplexer 8. The duplexer 8 thus leads to a lower part of the section and an upper part of the section. The ends of the interrupted section are referenced $\mathbf{9}_{11}$ and $\mathbf{9}_{12}$.

The upper end $\mathbf{9}_{11}$ of the lower part of the section $\mathbf{9}_1$ is provided with an RF cable choke 11 sized for the UHF frequencies. The function of this RF cable choke especially is to isolate the signals of the UHF band while, at the same time, remaining transparent to the signals of the VHF band. The technique used to make this RF cable choke is, for example, a quarter-wave skirt known to those skilled in the art. A tubular skirt body $\mathbf{11}_{11}$ surrounds the section $\mathbf{9}_1$ of the coaxial line and the lower edge $\mathbf{11}_2$ of this skirt body is shorted by a lid $\mathbf{11}_4$ to the shielding $\mathbf{9}_B$ of the coaxial line while the upper edge $\mathbf{11}_3$ is left open to ensure the RF cable choke function.

A duplexer-adapter 8 is positioned between the lower part and the upper part of the section. The duplexer-adapter 8 is connected to the ends $\mathbf{9}_{11}$ and $\mathbf{9}_{12}$ for example by connecting the shielding of these ends to the common ground 12 of the duplexer-adapter 8 and by connecting the cores of the ends $\mathbf{9}_{11}$ and $\mathbf{9}_{12}$ of this coaxial line respectively to the input terminal $\mathbf{8}_1$ and to the output terminal $\mathbf{8}_2$ of the VHF channel of the duplexer-adapter 8. This duplexer-adapter comprises a low-pass filter 13 which behaves like a direct connection between the input terminals $\mathbf{8}_1$ and $\mathbf{8}_2$ for the VHF signals and an open circuit for the UHF signals. For the VHF signals, it all happens as if the cut made in the line section $\mathbf{9}_1$ did not exist and the VHF signals can therefore be conveyed up to the power supply device 4. By contrast, the high-pass filter 14 of the duplexer-adapter behaves like a direct connection between the input terminal $\mathbf{8}_1$ and the output terminal $\mathbf{8}_3$ of the UHF channel for the UHF signals which are therefore picked up from the input terminal $\mathbf{8}_1$ and conveyed to the output terminal $\mathbf{8}_3$.

Figure 6:
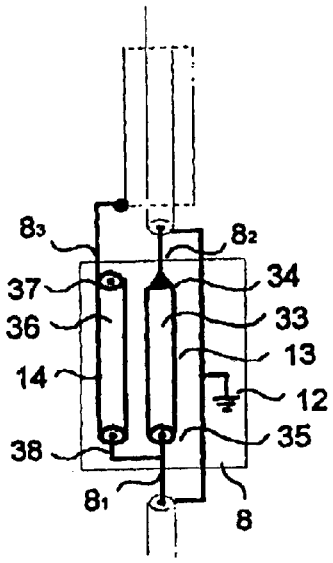
FIG. 6 shows an exemplary embodiment of a duplexer.

A detailed example of a duplexer-adapter is given in FIG. 6.

Between the end $\mathbf{9}_{12}$ of the line section and the upper reference mark $\mathbf{10}_2$, several hollow elements such as cylindrical tubes $\mathbf{15}i$ are positioned, for example, around the coaxial line in order to constitute radiating elements for the UHF signals. The length L of these elements is, for example, in the range of the mean half wavelength corresponding to the UHF band. The elements have, for example, substantially identical lengths. The insulating parts used to maintain the coaxial line in the cylindrical tubes or to ensure the joining and rigidity of the assembly are not described in detail because they are known to those skilled in the art. The radiating elements $\mathbf{15}i$ are connected to one another by means of coaxial line portions. For example, they are coupled in series. The length of a portion $\mathbf{16}i$ is substantially equal to the mean half wavelength corresponding to the UHF band. The core $\mathbf{17}i$ of a portion $\mathbf{16}i$ connects the upper end $\mathbf{15}_{i2}$ of the element $\mathbf{15}_i$ to the lower end $\mathbf{15}_{(i+1)1}$ of the element $\mathbf{15}_{(i+1)1}$. Thus, the core $\mathbf{17}_1$ of the line portion $\mathbf{16}_1$ connects the upper end $\mathbf{15}_{12}$ of the lower element $\mathbf{15}_1$ to the lower element $\mathbf{15}_{21}$ of the element $\mathbf{15}_2$ and the core $\mathbf{17}_2$ of the line portion $\mathbf{16}_2$ connects the upper end $\mathbf{15}_{22}$ of the element $15_2$ to the lower end $15_{31}$ of the element $15_3$. The shieldings $18_1$ and $18_2$ of the line portions $16_1$ and $16_2$ are connected for example electrically to the shielding of the coaxial line $9_1$. The radiating assembly constituted for example by the cylindrical tubes $15_1$, $15_2$ and $15_3$ and the link portions $16_1$ and $16_2$ is supplied with RF power of the UHF band by the connecting of the lower end $15_{11}$ of the cylindrical hollow element $15_1$ closest to the duplexer-adapter to the output terminal of $8_3$ of the duplexer-adapter. In order to radioelectrically insulate the upper part of this radiating assembly from the part of the coaxial line located above the upper reference mark $10_2$, a lid 19 is placed, for example, towards the middle of the upper tube $15_3$ to short this tube to the shielding of the coaxial line. A quarter-wave skirt 20 of the same type as that of the lower part is thus constituted to perform the role of an RF cable choke for the UHF signals.

The number of the cylindrical tubes is chosen especially as a function of the directivity desired for the UHF antenna. Without departing from the framework of the invention, the structure of the antenna described can be applied also to antennas working in other frequency bands, while meeting the condition according to which these frequency bands should not be adjacent. Any hollow element, whatever its shape, can be used as a radiating element.

Figure 5:
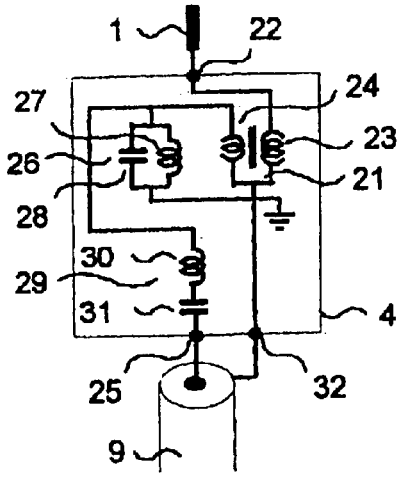
FIG. 5 shows an exemplary power supply device.

FIG. 5 describes an exemplary power supply device 4. This device has an impedance transformer 21. The output of the secondary winding 23 of this transformer 21 is connected to the upper radiating element 1. The primary winding 24 of this impedance step-up transformer is connected at the connection point 25 to the core of the transmission line 9 through a parallel LC circuit 26 consisting of an inductor 27 and a capacitor 28, followed by a serial LC circuit 29 consisting of an inductor 30 and a capacitor 31. The ground of this matching circuit is connected to the shielding of the coaxial transmission line 9 at the connection point 32. The value of the transformer ratio of the transformer 21 and the values of the inductors 27, 30 and of the capacitors 28, 31 are determined so that the impedance presented between the connection points 25 and 32 is as close as possible to the usual characteristic impedance of 50 ohms for all the frequencies of the 30–88 MHz band.

FIG. 6 gives a detailed view of an exemplary embodiment of the duplexer-adapter. The low-pass filter 13 is formed by a coaxial line portion 33, a first end 34 of which is shorted (i.e. the core and the shielding of the coaxial line are connected together) and constitutes the terminal $8_2$. The opposite end 35 of this coaxial line portion 33 has its core connected to the terminal $8_1$ and has its shielding left free. The high-pass filter 14 is formed by a coaxial line portion 36. The shielding 37 of the upper end of this coaxial line portion 36 constitutes the terminal $8_3$ and the core 38 of the other end of this coaxial line portion 36 is connected to the terminal $8_1$. The lengths of the portions 33 and 36 are in the range of a mean quarter wavelength corresponding to the UHF band and are adjusted to enable the impedance matching of the antenna assembly 10 with the UHF frequencies used.

Figure 7:
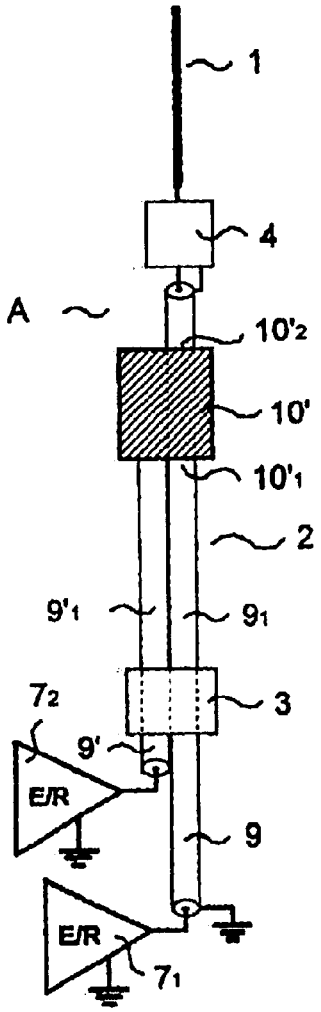
FIGS. 7 and 8 show an alternative embodiment of the system of FIG. 3, FIGS. 9 and 10 show an alternative embodiment of the system shown in FIGS. 7 and 8.

FIG. 7 shows another alternative embodiment of the invention.

The antenna according to the invention herein has two separate access ports enabling the connection of the two transmitter-receiver stations $7_1$ and $7_2$, one of which works in the 30–88 MHz VHF band while the other works in the 2.4–2.5 GHz UHF band.

The station $7_1$ of the VHF band is connected, for example, to the power supply device 4 by the coaxial transmission line 9 which flows through the RF cable choke 3 and an antenna assembly 10'.

The station $7_2$ of the UHF band is connected, for example, to the radiating elements **15*i* of the antenna assembly 10' by the section $9'_1$ of the coaxial secondary transmission line 9' which crosses the choke 3**.

Figure 8:
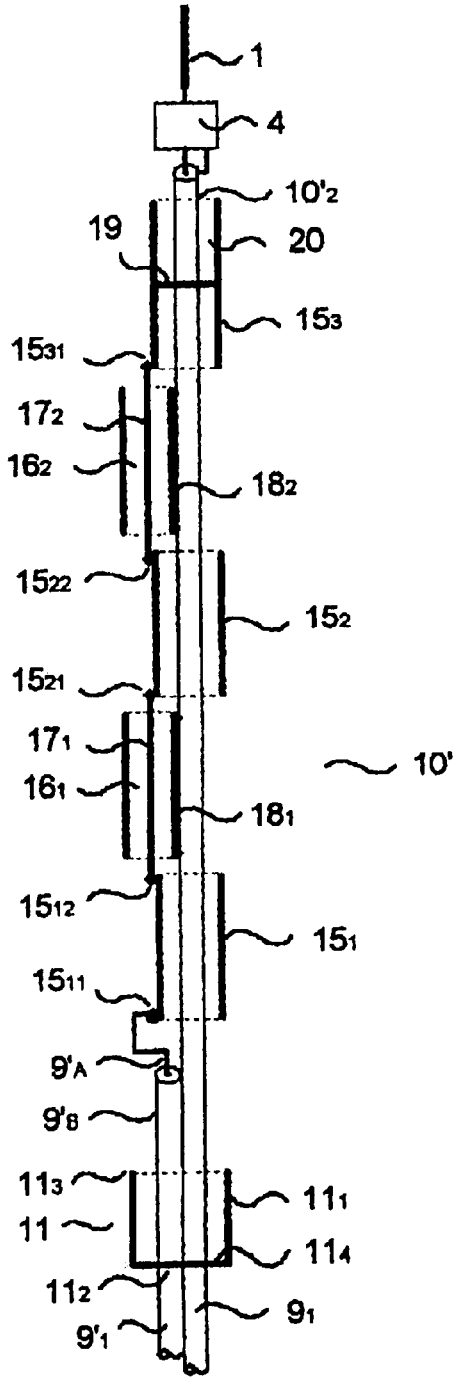

This antenna assembly 10', whose design details are shown in FIG. 8, does not have any duplexer-adapter unlike the antenna assembly given in the previous example. The coaxial line section $9_1$ remains uninterrupted between the choke 3 and the power supply device 4. The power supply to the radiating tubular elements **15*i* is obtained by connecting the lower end $15_{11}$ of the element $15_1$, closest to the line section $9'_1$ to the core $9'_A$ of this section $9'_1$ whose shielding $9'_B$ is fixedly joined to that of the section $9'_1$ of the coaxial line 9. In this way, the shieldings of the line sections $9_1$ and $9'_1$ behave radioelectrically like a single shielding during the passage through the chokes 3 and 11**. The other end of the secondary coaxial line is connected to the UHF band transmitter-receiver station $7_2$.

Figure 9:
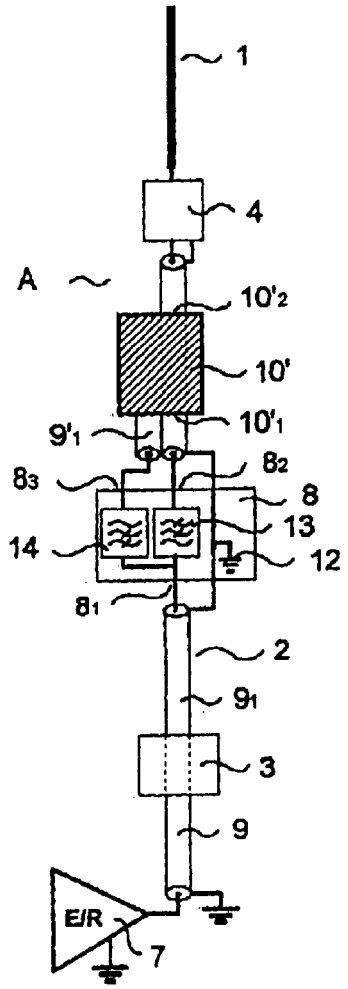
Figure 10:
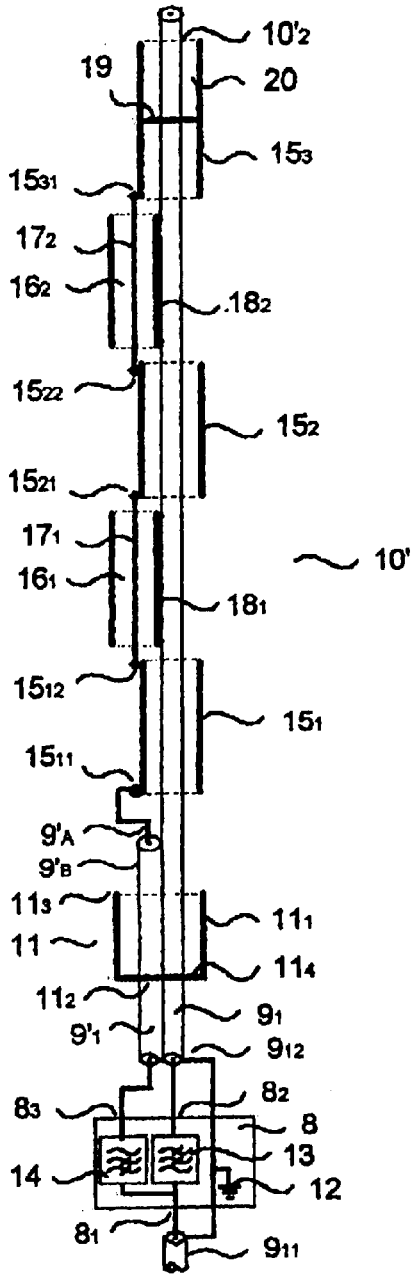

FIGS. 9 and 10 give a diagrammatic view of an alternative embodiment described in FIGS. 7 and 8 in which the two transmitters $7_1$ and $7_2$ are replaced by a single transmitter 7 which directly powers the transmission line 9. This line is interrupted in such a way as to position a duplexer 8 in a manner similar to the one described in FIG. 4. This duplexer powers the two line sections $9_1$ and $9'_1$ which have been described in detail in FIGS. 7 and 8.

FIG. 10 gives a detailed view of the link between the duplexer 8 and the line sections $9_1$ and $9'_1$.

The connection of the duplexer-adapter 8 to the ends $9_{11}$ and $9_{12}$ of the interrupted line section $9_1$ is made, for example, by connecting the shielding of these ends to the common ground 12 of the duplexer-adapter 8 and by connecting the cores of the ends $9_{11}$ and $9_{12}$ of this coaxial line respectively to the input terminal $8_1$ and to the output terminal $8_2$ of the VHF channel of the duplexer-adapter 8. For the link with the secondary line $9'_1$, this line is linked with the output $8_3$ of the UHF channel This duplexer-adapter comprises a low-pass filter 13 which behaves like a direct connection between the input terminals $8_1$ and $8_2$ for the VHF signals and an open circuit for the UHF signals. For the VHF signals, it all happens as if the cut made in the coaxial line 9 does not exist and the VHF signals can therefore be conveyed up to the power supply device 4. However, the high-pass filter 14 of the duplexer-adapter behaves like a direct connection between the input terminal $8_1$ and the output terminal $8_2$ of the UHF channel for the UHF signals which are therefore picked up from the input terminal $8_1$ and conveyed up to the output terminal $8_3$ in order to power the line section $9'_1$.

In this example, the choke 11 sized for the frequencies UHF is located on the two transmission lines $9_1$ and $9'_1$ and beyond the duplexer. It has characteristics identical or substantially identical to those given in FIG. 4 and, in fact, shall not be described in detail

What is claimed is:

1. A wideband antenna system, capable of radiating or receiving signals in a low-frequency band covering more than one octave and a high-frequency band with Fhb>= 2Fbh, comprising:

a power supply device powering an upper radiating element and a lower radiating element, wherein the lower radiating element is provided with an antenna assembly adapted to radiate in the high-frequency band, wherein several hollow elements indexed i, said elements being connected to one another and serially by line portions indexed i, the core of one line portion connecting the upper end of the hollow element indexed i to the lower end of the element indexed i+1 and the shielding of the line portion is connected to the coaxial line.

2. The system according to claim 1, wherein the power supply device is connected to a transmitter-receiver station by a transmission line and wherein the lower radiating element is constituted by a section of the transmission line and the antenna assembly comprises at least one hollow radiating element positioned around the section.

3. The antenna system according to claim 1, comprising a duplexer at the lower part of the antenna assembly and connected to at least one hollow element and to the section.

4. The antenna system according to claim 3, wherein the duplexer comprises at least one low-pass filter comprising a shorted coaxial line portion and/or at least one high-pass filter constituted by a coaxial line portion in an open circuit.

5. The antenna system according to claim 4, comprising a first transmitter-receiver station working in the low-frequency band connected to a first transmission line and a second transmitter-receiver station working in the high-frequency band connected to a second coaxial transmission line, the second line being also linked with one of the radiating hollow elements, the shielding of the two lines being connected together.

6. The antenna system according to claim 1, comprising a first transmitter-receiver station working in the low-frequency band connected to a first transmission line and a second transmitter-receiver station working in the high-frequency band connected to a second coaxial transmission line, the second line being also linked with one of the radiating hollow elements, the shielding of the two lines being connected together.

7. The antenna system according to claim 1, comprising a choke.

8. The antenna system according to claim 1, wherein the power supply device comprises a parallel LC circuit.

9. The antenna system according to claim 1, wherein the power supply device comprises an impedance transformer.

10. The antenna system according to claim 9, wherein the power supply device further comprises a parallel LC circuit.

11. The antenna system according to claim 10, wherein the power supply further comprises a serial LC circuit.

12. The antenna system according to claim 10, comprising a duplexer at the lower part of the antenna assembly and connected to at least one hollow element and to the section.

13. The antenna system according to claim 1 wherein the signals are radio frequency signals.

14. The antenna system according to claim 7, wherein the choke is a quarter wave skirt.

15. The antenna system according to claim 1, wherein the power supply device comprises a serial LC circuit.

16. A wideband antenna system, capable of radiating or receiving signals in a low-frequency band [Fbb, Fbh] covering more than one octave and a high-frequency band [Fhb, Fhh] with Fhb>=2Fbh comprising at least one power supply device powering at least one upper radiating element and at least one lower radiating element, wherein the lower radiating element is provided with at least one antenna assembly adapted to radiating in the high-frequency band [Fhb, Fhh], wherein a first transmitter-receiver station working in the low-frequency band connected to a first transmission line and a second transmitter-receiver station working in the high-frequency band connected to a second coaxial transmission line, the second line being also linked with one of the radiating hollow elements, the shielding of the two lines being connected together.

17. A The antenna system according to claim 16, comprising several hollow elements i, said elements being connected to one another and serially by means of line portions indexed i, the core of one line portion connecting the upper end of the hollow element indexed i to the lower end of the element indexed i+1 and the shielding of the line portion is connected to the coaxial line.

18. The antenna system according to claim 17, comprising a duplexer at the lower part of the antenna assembly and connected to at least one hollow element and to the section.

19. The system according to claim 16, wherein the power supply device is connected to a transmitter-receiver station by a transmission line and wherein the lower radiating element is constituted by a section of the transmission line and the antenna assembly comprises at least one hollow radiating element positioned around the section.

20. The antenna system according to claim 16, comprising a duplexer at the lower part of the antenna assembly and connected to at least one hollow element and to the section.

21. The antenna system according to claim 20, wherein the duplexer comprises at least one low-pass filter comprising a shorted coaxial line portion and/or at least one high-pass filter constituted by a coaxial line portion in an open circuit.

22. The antenna system according to claim 20, comprising a first transmitter-receiver station working in the low-frequency band connected to a first transmission line and a second transmitter-receiver station working in the high-frequency band connected to a second coaxial transmission line, the second line being also linked with one of the radiating hollow elements, the shielding of the two lines being connected together.

23. The antenna system according to claim 16, comprising a choke.

24. The antenna system according to claim 23, wherein the choke is a quarter wave skirt.

25. The antenna system according to claim 16, wherein the power supply device comprises an impedance transformer.

26. The antenna system according to claim 25, wherein the power supply device further comprises a parallel LC circuit.

27. The antenna system according to claim 26, wherein the power supply further comprises a serial LC circuit.

28. The antenna system according to claim 16, wherein the signals are radio frequency signals.

29. The antenna system according to claim 16, wherein the power supply device comprises a parallel LC circuit.

30. The antenna system according to claim 16, wherein the power supply device comprises a serial LC circuit.

* * * * *